US005664453A

United States Patent [19]

Abo et al.

[11] Patent Number: 5,664,453

[45] Date of Patent: Sep. 9, 1997

[54] HOLLOW EXTRUDER DIE FOR EXTRUDING A HOLLOW MEMBER OF A ZINC-CONTAINING ALUMINUM ALLOY

[75] Inventors: Mitsuo Abo; Yasuyuki Tanaka; Hidenori Kumazaki, all of Nagoya; Fumihiko Sato, Inazawa; Hiroyuki Wakabayashi, Nagoya, all of Japan

[73] Assignee: Sumitomo Light Metal Industries, Ltd., Tokyo-To, Japan

[21] Appl. No.: 725,186

[22] Filed: Oct. 2, 1996

Related U.S. Application Data

[63] Continuation of Ser. No. 345,119, Nov. 28, 1994, abandoned.

[30] Foreign Application Priority Data

Dec. 1, 1993 [JP] Japan ..... 5-301873
Dec. 1, 1993 [JP] Japan ..... 5-301874

[51] Int. Cl.[6] ..... B21C 25/02

[52] U.S. Cl. ..... 72/269; 72/467; 72/700

[58] Field of Search ..... 72/264, 269, 462, 72/467, 700

[56] References Cited

U.S. PATENT DOCUMENTS

| | | | |
|---|---|---|---|
| 3,230,759 | 1/1966 | Schoenfeld et al. | 72/467 |
| 4,773,251 | 9/1988 | Kohnhauser et al. | 72/467 |

FOREIGN PATENT DOCUMENTS

| | | | |
|---|---|---|---|
| 0 202 187 | 11/1986 | European Pat. Off. . | |
| 0 349 524 | 1/1990 | European Pat. Off. . | |
| 0 566 346 | 10/1993 | European Pat. Off. . | |
| 2521369 | 11/1976 | Germany | 72/467 |
| 178122 | 10/1984 | Japan | 72/467 |
| 1-73054 | 3/1989 | Japan . | |
| 2-46914 | 2/1990 | Japan . | |
| 315716 | 11/1994 | Japan | 72/462 |

*Primary Examiner*—Lowell A. Larson
*Attorney, Agent, or Firm*—Davis and Bujold

[57] ABSTRACT

A hollow extruding die for extruding a hollow section of a zinc-containing aluminum alloy is provided. The die is protected from cracks and has an extended life, without requiring any substantial structural changes to the die. In the die mandrel of the die a mandrel is connected by bridges with an outer cylindrical member. The bridges have a tapered projection facing toward the mandrel. A 3 mm thick coating composed of a nickel alloy is bonded on the surface of the projection by padding the welding material. Instead of coating the bridges, a covering can be attached to the surface of the bridges. To receive the covering, an engaging groove extends from the root of the mandrel and along the surface of the bridges to the outer cylindrical member of the die mandrel. The covering is composed of the same steel material as that of the die or of the nickel alloy. The covering has a through hole for receiving the mandrel formed on the base. At the opposite sides of the through hole, the covering has projecting portions that are disposed parallel to the mandrel and the covering is tapered along the bridges.

12 Claims, 13 Drawing Sheets

HOLLOW EXTRUDER DIE FOR EXTRUDING A HOLLOW MEMBER OF A ZINC-CONTAINING ALUMINUM ALLOY

This application is a continuation of application Ser. No. 08/345,119 filed on Nov. 28, 1994, now abandoned.

FIELD OF THE INVENTION

This invention relates to a hollow extruder die for extruding an aluminum alloy containing zinc to form hollow sections having a square cylindrical, circular cylindrical, tubular or pipe configuration.

BACKGROUND OF THE INVENTION

Conventionally, aluminum alloy is extruded through a die P1 as shown in FIG. 10A, to form a hollow section of aluminum alloy. The die P1 is a port-hole die provided with a die mandrel P2 shown by a solid line in FIG. 10B for forming a hole in the hollow section. A die cap P3 shown by a two-dot dashed line is provided,in combination with the die mandrel P2, for forming the peripheral portion of the hollow section.

A mandrel P5 projects from a mandrel support P4 in the center of the die mandrel P2 of the die P1 for forming the hole in the hollow section. The die cap P3 has an inner surface P6 of an extruding hole for forming the peripheral portion of the hollow section. When the die mandrel P2 is assembled with the die cap P3, an extruding orifice P7 is defined by the tip of mandrel P5 and the inner surface P6. By forcing the extruding material through the orifice P7, the hollow section is extruded.

When the hollow section of aluminum alloy is extruded from the die P1, an output of at least 10 tons per die is generally achieved. When 7000 series Al—Zn—Mg alloy (according to Japanese Industrial Standards) or other zinc-containing aluminum alloy is extruded, however, the die P1 provides an output of less than 1 ton per die. Moreover, when extruding a zinc alloy, the conventional die P1 has a short useful life and provides little productivity as a tool.

The conventional die P1 partially cracks during the extrusion. Bridges P8 shown in FIG. 10A adjacent to the root portion "a" of support P4 of mandrel P5 are especially easily cracked due to the stress concentrations at the root portion "a" shown in FIG. 10B under the extruding load.

Others have attempted to reduce the concentrated stress by modifying the structure of the die P1. However, this merely complicates the structure of die P1 and increases the difficulty and expense in processing and assembling the die. Since increased precision in the dimensions and configuration of the extruded section is continually demanded by the industry, modifications of the die structure is not a satisfactory solution for providing the necessary reduction in concentrated stress. Furthermore, as the structure changes, the stress concentration merely shifts to another portion of the die. Consequently, cracks are simply shifted to another portion of the die, and no cracks are eliminated.

SUMMARY OF THE INVENTION

Wherefore, an object of this invention is to provide a hollow die for extruding a hollow section of a zinc-containing aluminum alloy which is protected from cracks and has an extended useful life, without entailing structural changes which adversely affect the precision required in the dimensions of the extruded hollow section.

Another object of the invention is to provide a covering attached to the mandrel of a die for extending the life of the die.

To attain this or other objects, the present invention provides a hollow extruder die for extruding a hollow section of a zinc-containing aluminum alloy, in which a die mandrel having a mandrel for forming a hollow in an extruded section is combined with a die cap having an extruding hole for forming the peripheral portion of the extruded section. The root of the mandrel of the die mandrel is coated with a material that resists the brittleness caused by zinc.

The coated root corresponds to the upstream facing surface of a bridge for supporting the mandrel.

The coating providing a resistance to the brittleness caused by zinc is composed by weight of 53%Ni-18.0%Cr-3.1%Co-18.5% Fe-0.18%Si; 53%Ni-17.5%Cr-18.5%Co-4%Mo or an other nickel alloy. The alloys preferably contain at least 40% by weight of nickel. Moreover, the molybdenum material resists the brittleness caused by zinc, and does not cause the aluminum alloy to seize at high temperatures. The molybdenum material preferably contains at least 50% by weight of molybdenum. It can be appreciated that other super hard alloys having a suitable resistance to the brittleness caused by zinc and that do not cause the aluminum alloy to seize at high temperatures may be used. Among the super hard alloys, 20Co-WC is most preferable. Alternatively, cobalt, chromium, tantalum, titanium, niobium, wolfram or other suitable super hard alloy containing these metals can be used.

The coating layer is 10 mm thick at maximum. The thickness varies with the material of the coating layer.

The coating layer, even under a large extruding stress, must have a strong bond and be difficult to peel off. Therefore, the coating layer is formed by padding the welding material, e.g. building the layer up bit by bit, thermal spraying, chemical coating or other suitable method.

Cracks made in the die when a 7000 series Al—Zn—Mg alloy is extruded are not accompanied by large plastic deformation. The cracks are made by the brittleness caused by zinc when zinc in the aluminum alloy extruding material is dispersed in the grain boundary of the steel material composing the die. If the extruding material of aluminum alloy is prevented from coming into direct contact with the stress concentrated portions of the steel die, cracks can be avoided. Therefore, the surface of the steel die is coated with a layer that is resistant to the brittleness caused by zinc and has a resistance to the stress caused by the flow of extruding material.

In the invention, by coating the root of the mandrel with a layer that protects the mandrel from the brittleness caused by zinc, the cracks are avoided and the durability of the die is increased.

In another aspect, the invention provides a hollow extruder die for extruding a hollow section of a zinc-containing aluminum alloy. The die is formed of a die mandrel having a mandrel for forming a hollow in an extruded section in combination with a die cap having an extruding hole for forming the peripheral portion of the extruded section. A removable or fixed covering is disposed on the upstream facing surface of the support portion for protecting the root of the mandrel of the die mandrel. The material of the covering has a resistance to the brittleness caused by zinc.

However, since the extruding material only passes along the covering, the covering itself requires little rigidity. As such, the material of the covering may be the same steel material as that of the die. Alternatively, the covering may be formed of the same material as that of the aforementioned coating, i.e. the molybdenum material, super hard alloy or other suitable material can be used.

The covering has a substantially triangular cross section. The tip of the triangle corresponding to the upstream face of the bridge is tapered. The configuration of the cross section of the covering is not limited to a triangle. The covering for a 1500 ton extruder die is 2 mm to 30 mm thick. However, the thickness of the covering varies with the material forming the covering.

In addition, by providing an engaging groove in the bridge, the covering can be either removably or fixedly disposed in the groove. Furthermore, when the die mandrel is assembled with the die cap, these can securely hold the covering therebetween.

By disposing the removable or fixed covering on the upstream facing surface of the mandrel support portion of the die mandrel or the upstream facing surface of the bridge, the aluminum alloy extruding material is prevented from directly contacting the areas of high stress concentration in the steel material composing the die.

When the covering is disposed on the portion which tends to easily crack, stress is placed onto the covering during extrusion, thereby sometimes cracking the covering. The die itself, however, is indirectly subjected to the stress and therefore has an extended life. If the covering is removable, it can be easily replaced with a new one when it cracks.

When the material of the covering is resistant to the brittleness caused by zinc, however, the durability of the covering is extended, and the covering need not be removable.

BRIEF DESCRIPTION OF THE DRAWINGS

The invention will now be described, by way of example, with reference to the drawings, in which.

DETAILED DESCRIPTION OF THE PREFERRED EMBODIMENTS FIRST EMBODIMENT

Figure 1A:
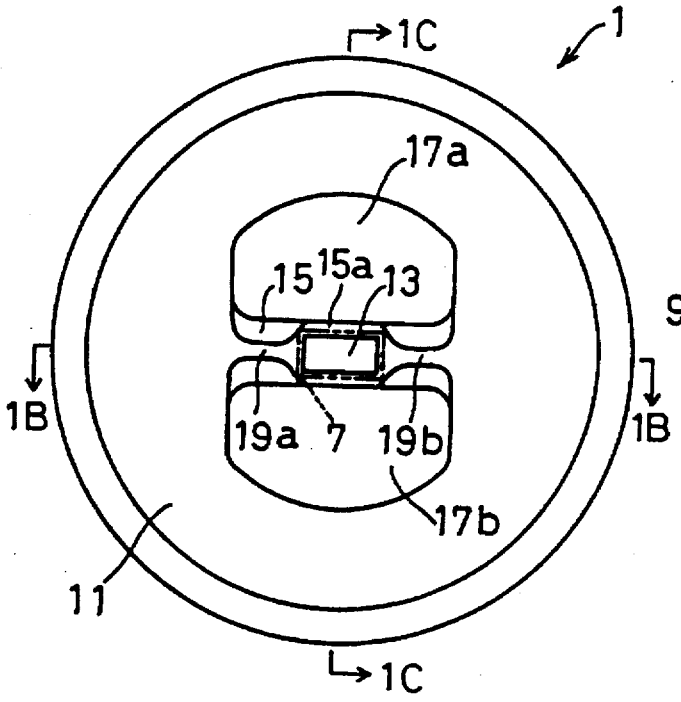
FIG. 1A is a plan view of a hollow die according to a first embodiment of the invention.
Figure 1C:
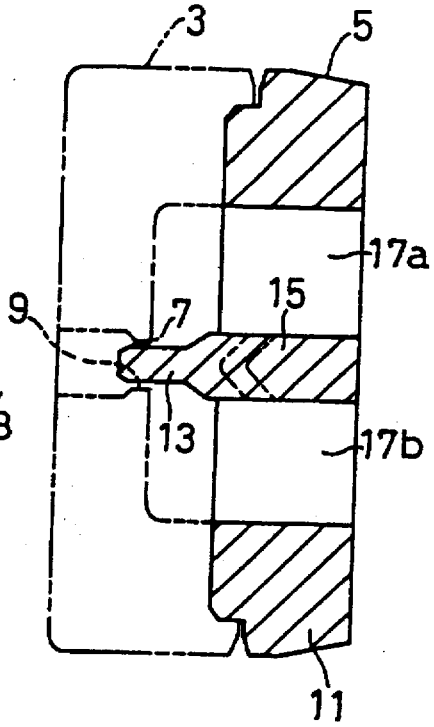
FIG. 1C is a cross-sectional view of the hollow die taken along lines 1C—1C in FIG. 1A.
Figure 1B:
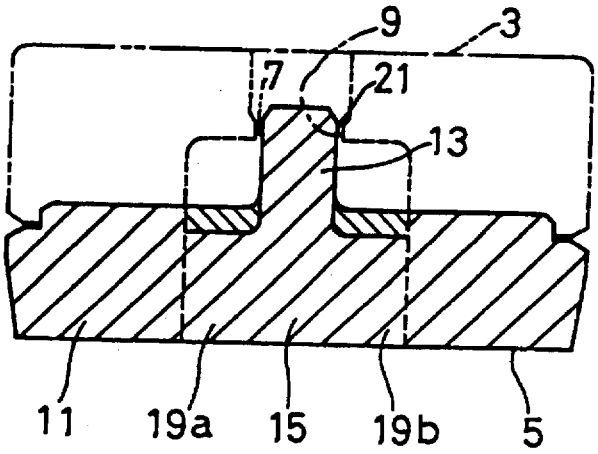
FIG. 1B is a cross-sectional view of the hollow die taken along lines 1B—1B in FIG. 1A.
Figure 3A:
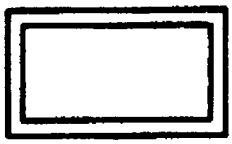
FIGS. 3A, 3B and 3C are an explanatory views showing the configuration of an extruded section.

As shown in FIGS. 1A, 1B and 1C, a hollow die 1 is the combination of a die cap 3 shown by a two-dot dashed line and a die mandrel 5 shown by a solid line. An extruder material is forced through an orifice 7 formed by the assembled die cap and mandrel 3,5 to extrude a square cylindrical section as shown in FIG. 3A. The die cap 3 has an extruding hole 9 for forming the peripheral portion of an extruded section, while the die mandrel 5 is integrally formed of an outer cylindrical member 11, a mandrel 13 and a mandrel support 15.

As shown in FIG. 1C the outer cylindrical member 11 of the die mandrel 5 has an opening passing therethrough. The opening is transversely divided by the mandrel support 15 into opposite ports 17*a* and 17*b*.

The mandrel support 15 is a planar member formed of a central portion 15*a* in which the mandrel 13 is set in an upright position and of bridges 19*a* and 19*b* disposed on opposite sides of the mandrel 13. The mandrel 13 is a planar member having a rectangular cross section and has on its tip a bearing surface 21 for defining the orifice 7 with the inner wall of the die cap 3. The mandrel 13 is connected to the outer cylindrical member 11 by the opposing bridges 19*a*, 19*b*.

Figure 2A:
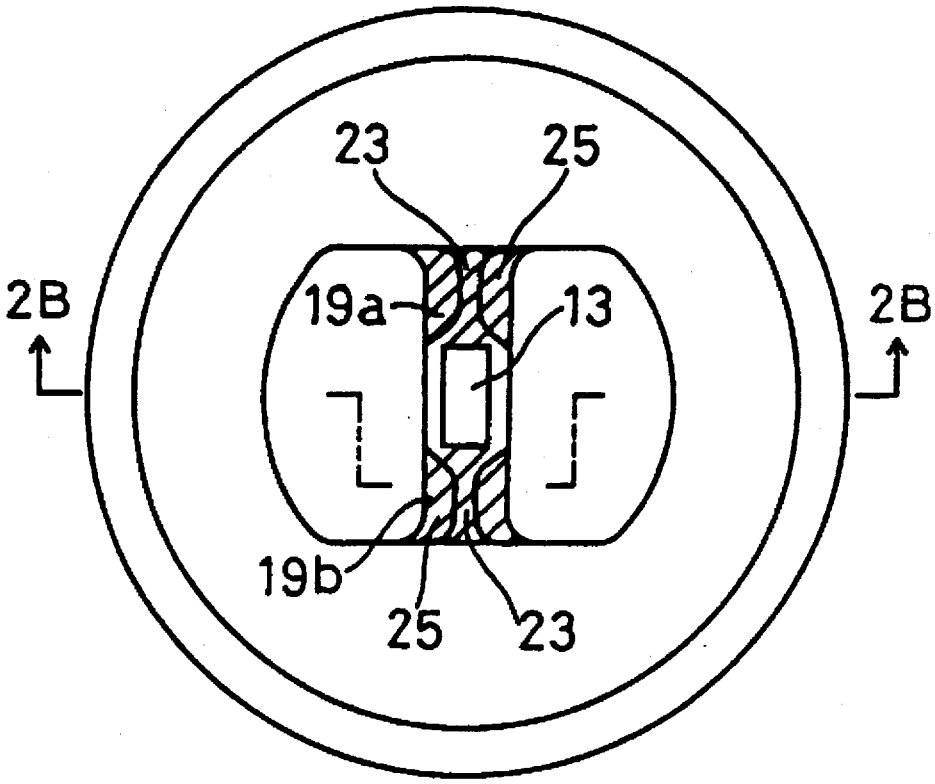
FIG. 2A is a plan view of the die mandrel shown in FIG. 1A.
Figure 2B:
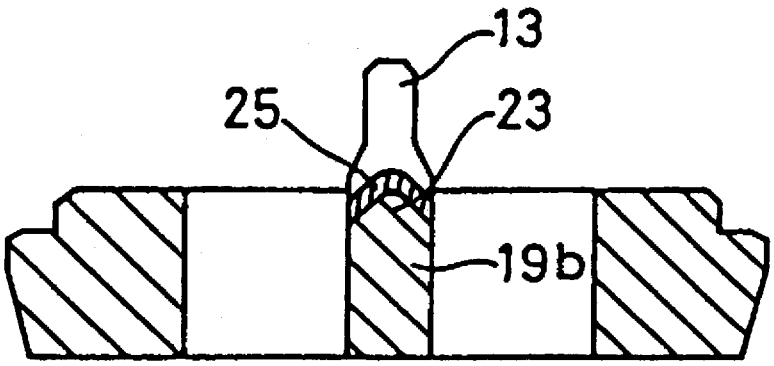
FIG. 2B is a cross-sectional view of the die mandrel taken along lines 2B—2B in FIG. 2A.

As shown in FIGS. 2A and 2B, the downstream face of each bridge 19*a*, 19*b* is tapered to form a projection 23 projecting downstream along opposite sides of the mandrel 13. The downstream facing, tapered surfaces of the projections 23 have a coating 25 thereon.

The coating 25 is a 3 mm thick layer formed of a nickel alloy comprised 53%Ni-18.0%Cr-3.1%Co-18.5%Fe-0.18%Si. By padding the welding material, e.g. building up a layer of material bit by bit, the coating 25 is firmly welded or bonded to the projections 23 on the bridges 19*a* and 19*b*, respectively.

During the welding, for example, a nickel alloy welding rod having a diameter of 2 mm is melted and bonded to the projection 23, such that the coating 25 is deposited over the projection 23. The surface of the coating 25 is then polished to provide a smooth finish.

The coating 25 of nickel alloy adds a resistance to the brittleness caused by zinc to the hollow die 1 of the first embodiment. Since the coating 25 is securely bonded to the bridges 19*a*, 19*b*, it will not crack or peel off and is durable.

EXPERIMENT 1

The extruding material was forced through a hollow die in order to determine whether the hollow die of the first embodiment is more durable in comparison with the reference example that is a conventional uncoated die.

In the experiment a die covered with the coating of nickel alloy and a conventional die having no coating were tested. Extrusion was conducted under the following conditions and the dies were examined for any resulting cracks or wear. The results are shown in Table 1.

EXPERIMENTAL CONDITIONS

Extruding material: 7N01 (Al-4.5Zn-1.2Mg according to Japanese Industrial Standards);

The steel material composing the die: SKD61 (according to Japanese Industrial Standards);

The composition of the nickel alloy material forming the coating: 53%Ni-18.0%Cr-3.1%Co-18.5%Fe-0.18%Si;

The shape of the extruded section: square cylindrical shape;

Extrusion conditions: billet heating temperature 520° C.; and extrusion speed 10 m/min.

TABLE 1

| DIE TYPE | EXTRUDER OUTPUT | RESULTS |
|---|---|---|
| FIRST EMBODIMENT | 3000 kg | NO WEAR ON THE DIE |
| REFERENCE EXAMPLE | 500 kg | A CRACK IN THE DIE |

Figure 3B:
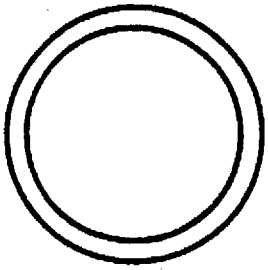
Figure 3C:
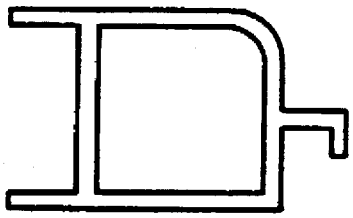
Figure 3D:
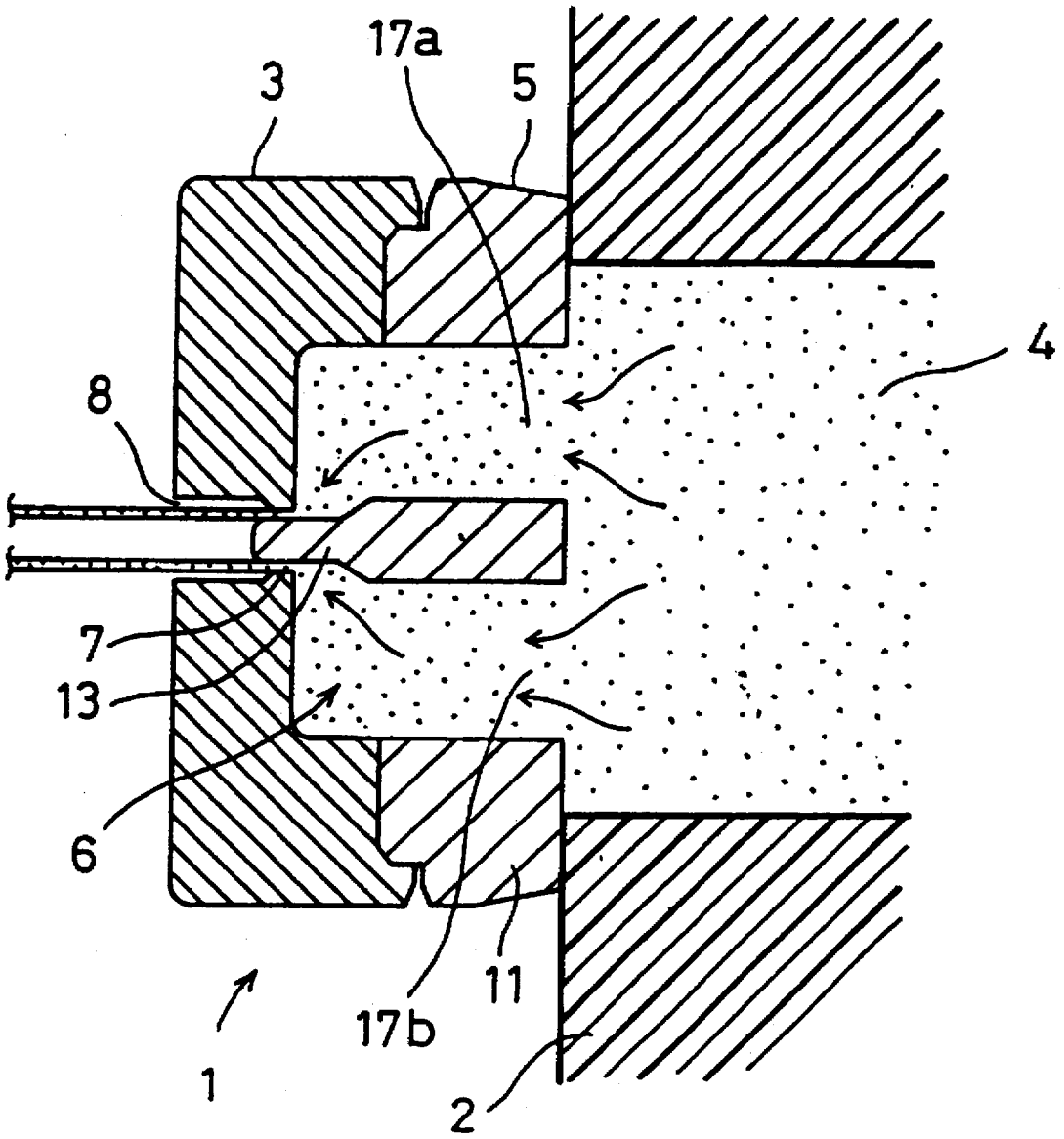
FIG. 3D is a cross-sectional view illustrating the extruding process.

As shown in FIG. 3D, the die 1 is disposed on a container 2, and a cylindrical billet 4 composed of the extruding material inserted into the container 2. The billet 4, the die 1 and the container 2 are heated to 520° C. Subsequently, the billet 4 is compressed by a not-shown stem. The material of billet 4 is forced through two ports 17*a* and 17*b*, and flows into and fills a chamber 6 completely surrounding the mandrel 13. When the pressure of the stem is increased such that the material of billet 4 flows through the orifice 7, it flows out of a die bore 8. The material forced through the ports 17*a* and 17*b* meets again at the tip of the mandrel 13 thereby forming the extruding material into a hollow section having the cross-sectional configuration shown in FIG. 3A.

As seen in Table 1, the die of the first embodiment with the coating of nickel alloy formed by padding the welding material did not wear or crack even when the extruder output was 3000 kg, and is superior in durability. The reference example having no coating thereon cracked when the extruder output reached 500 kg, and has relatively poor durability.

SECOND EMBODIMENT

Figure 4A:
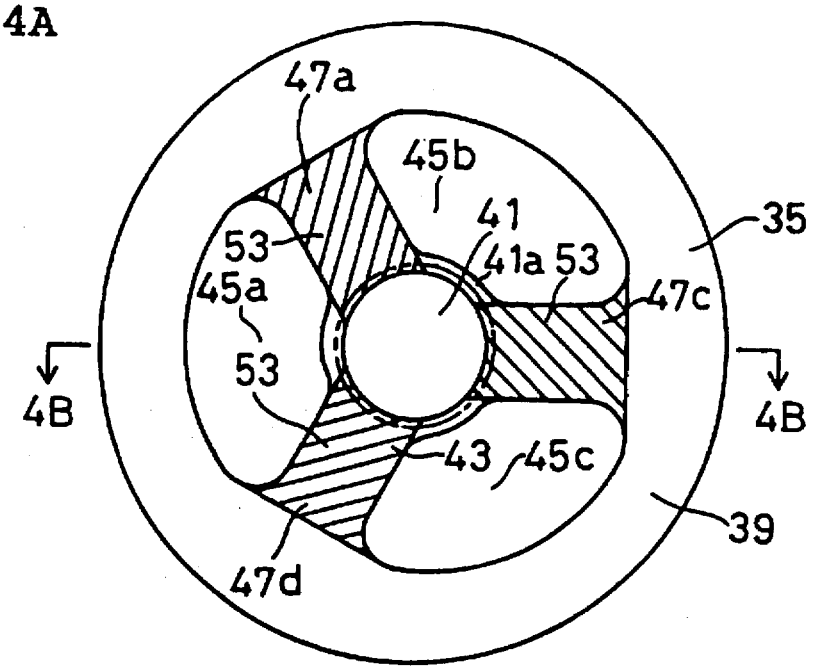
FIG. 4A is a plan view of a hollow die according to a second embodiment of the invention.
Figure 4B:
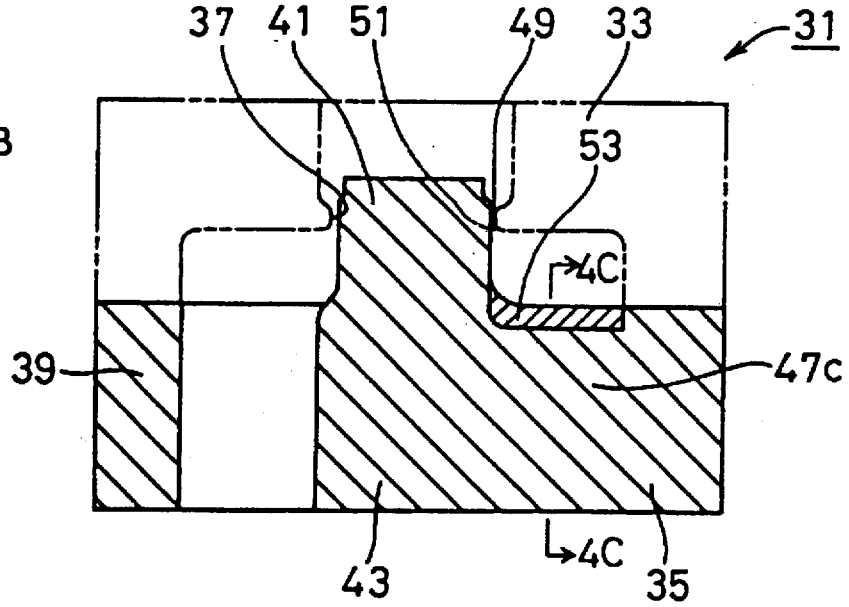
FIG. 4B is a cross-sectional view of the hollow die taken along lines 4B—4B in FIG. 4A.

As shown in FIGS. 4A and 4B, a hollow die 31 is the combination of a die cap 33 shown by a two-dot dashed line and a die mandrel 35 shown by a solid line. Different from the first embodiment, a circular cylindrical section as shown in FIG. 3B is extruded from the hollow die 31. The die cap 33 has an extruding hole 37 for forming the peripheral portion of the extruded section, while the die mandrel 35 is integrally formed of an outer cylindrical member 39, a mandrel 41 and a mandrel support 43.

As shown in FIG. 4A the outer cylindrical member 39 of the die mandrel 35 has an opening passing therethrough. The opening is divided by radially extending portions of the mandrel support 43 into three ports 45*a*, 45*b* and 45*c*. The mandrel support 43 is formed of a central portion 41*a* in which the mandrel 41 is set in an upright position. Three planar bridges 47*a*, 47*b* and 47*c* extend radially from the central portion 41*a* to the outer cylindrical member 30.

Figure 4C:
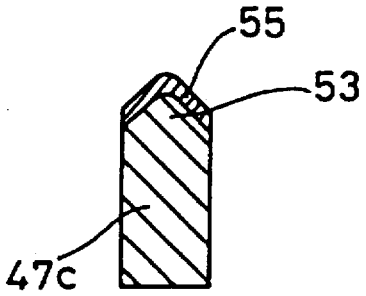
FIG. 4C is a cross-sectional view of the hollow die taken along lines 4C—4C in FIG. 4B.

The mandrel 41 has a circular cross section, and has on its tip a bearing surface 51 for defining a slight orifice 49 with the inner wall of the die cap 33. As shown in FIG. 4C, the upstream face of each bridge 47*a*, 47*b* and 47*c* is tapered to form a projection 53 projecting upstream along the sides of the mandrel 41 in the same manner as in the first embodiment. The upstream facing surfaces of the projections 53 have a coating 55 thereon.

The coating 55 is a 3 mm thick layer composed of a nickel alloy. The composition of the alloy is 53%Ni-17.5%Cr-18.5%Co-4%Mo. The covering 55 is firmly bonded to the projections 53 of the bridges 47*a*, 47*b* and 47*c* by padding the welding material.

EXPERIMENT 2

In the same way as in the first experiment, a hollow die of the second embodiment was tested under the following experimental conditions. The results are shown in Table 2.

EXPERIMENTAL CONDITIONS

Extruding material: 7003 (Al-6.0Zn-0.8Mg according to Japanese Industrial Standards);

The steel material composing the die: SKD61;

The composition of the nickel alloy material forming the coating: 53%Ni-17.5%Cr-18.5%Co-4%Mo;

The shape of the extruded section: circular cylindrical shape;

Extrusion conditions: billet heating temperature 520° C.; and extrusion speed 10 m/min.

TABLE 2

| DIE TYPE | EXTRUDER OUTPUT | RESULTS |
|---|---|---|
| SECOND EMBODIMENT | 5000 kg | NO WEAR ON THE DIE |
| REFERENCE EXAMPLE | 700 kg | A CRACK IN THE DIE |

As seen in Table 2, the die of the second embodiment with the coating of nickel alloy formed by padding the welding material did not crack or wear, even when the extruder output was 5000 kg, and is superior in durability. The reference example having no coating thereon cracked when the extruder output reached 700 kg, and has relatively poor durability.

THIRD EMBODIMENT

As shown in FIGS. 5A–7C, the components of the third embodiment that are similar to the components of the first embodiment are given the same denotation numbers in their last two digits as those shown in FIGS. 1A–2B. Therefore, the explanation of these alike components is omitted herein.

Figure 5A:
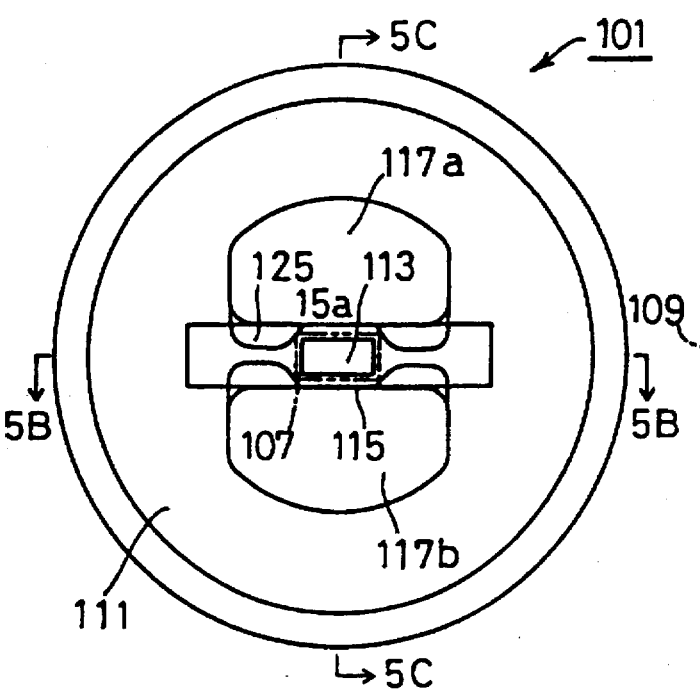
FIG. 5A is a plan view of a hollow die according to a the third embodiment of the invention.
Figure 5C:
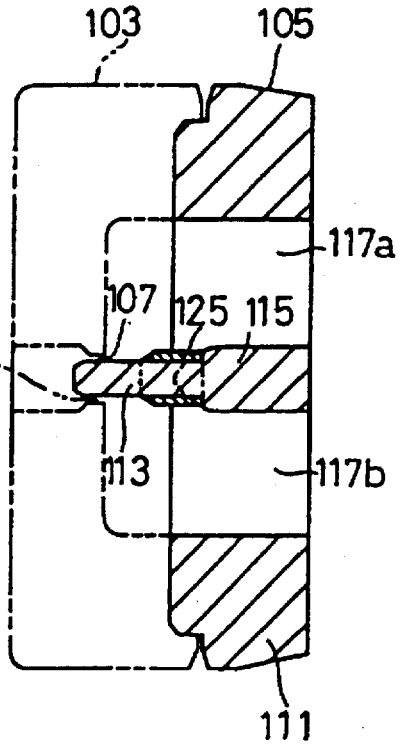
FIG. 5C is a cross-sectional view of the hollow die taken along lines 5C—5C in FIG.5A.
Figure 5B:
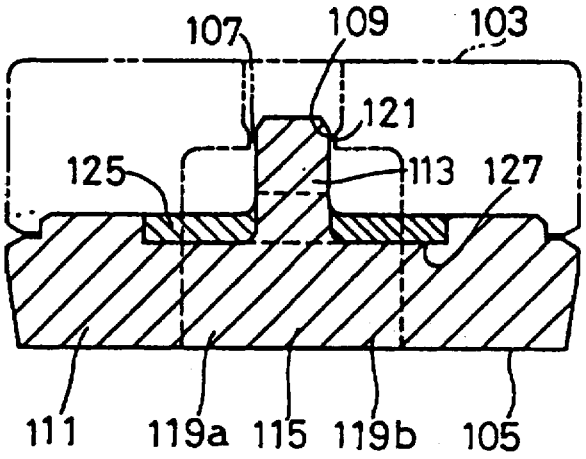
FIG. 5B is a cross-sectional view of the hollow die taken along lines 5B—5B in FIG. 5A.

In the third embodiment, as shown in FIGS. 5A–5C, a covering 125 is laid over the root of the mandrel 113 and the upstream facing surfaces of bridges 119*a* and 119*b*. An engaging groove 127 extends from the root of the mandrel 113, along the surface of the bridges 119*a*, 119*b* and partway into the outer cylindrical member 111, as shown in FIG. 7A in order to receive the covering 125.

Figure 6A:
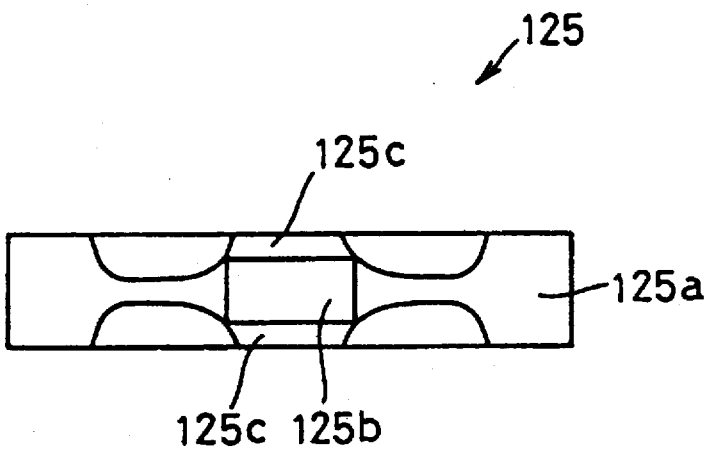
FIG. 6A is a plan view of a covering for the third embodiment.
Figure 6C:
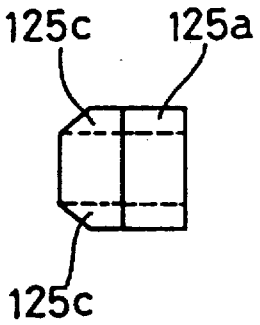
FIG. 6C is a side view of the covering.
Figure 6B:
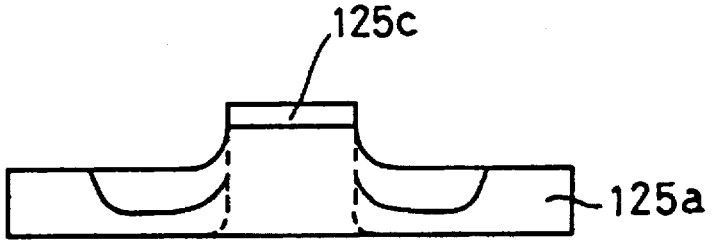
FIG. 6B is a front view of the covering.

The covering 125 is formed of SKD61 steel, the same steel material as that of die 101. As shown in FIGS. 6A–6C, the covering 125 has a through hole 125*b* in a base 125*a*, which is 20 mm wide, 130 mm long and 15 mm thick. A mandrel 113 is passed through the hole 125*b* in the base 125*a*. An upwardly projecting portion 125*c* extends upwardly along the sides of the mandrel 113 on opposite sides of the through hole 125*b*. The upstream facing edges of the base 125*a* are tapered along the bridges 119*a*, 119*b* in the same way as the upstream facing edges of the bridges of a conventional die.

Figure 7A:
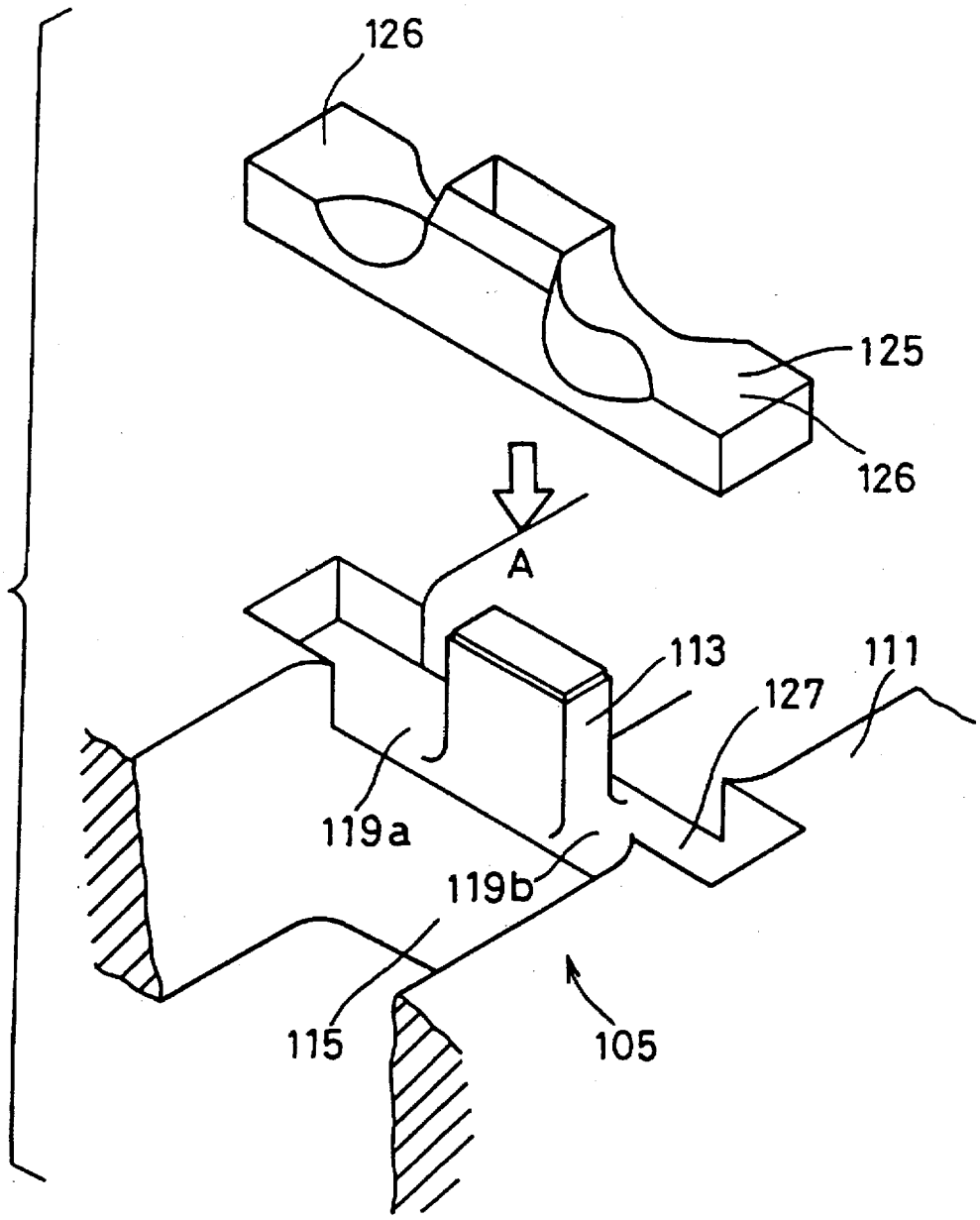
FIG. 7A is an explanatory exploded view showing how to attach the covering.

As shown in FIG. 7A, when the covering 125 is attached to a die mandrel 105, the covering 125 is inserted in the direction shown by arrow A into the groove 127 formed in the die mandrel 105 such that the mandrel 113 passes through the hole 125*b* in the covering 125.

Figure 7B:
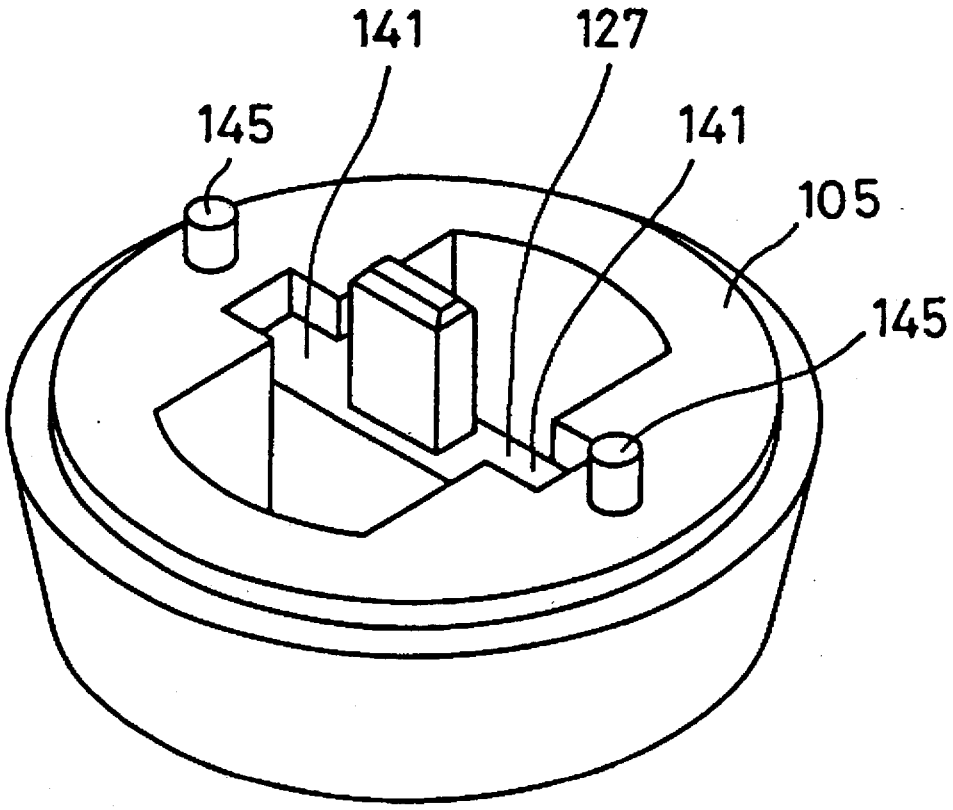
FIG. 7B is a perspective view of a die mandrel.
Figure 7C:
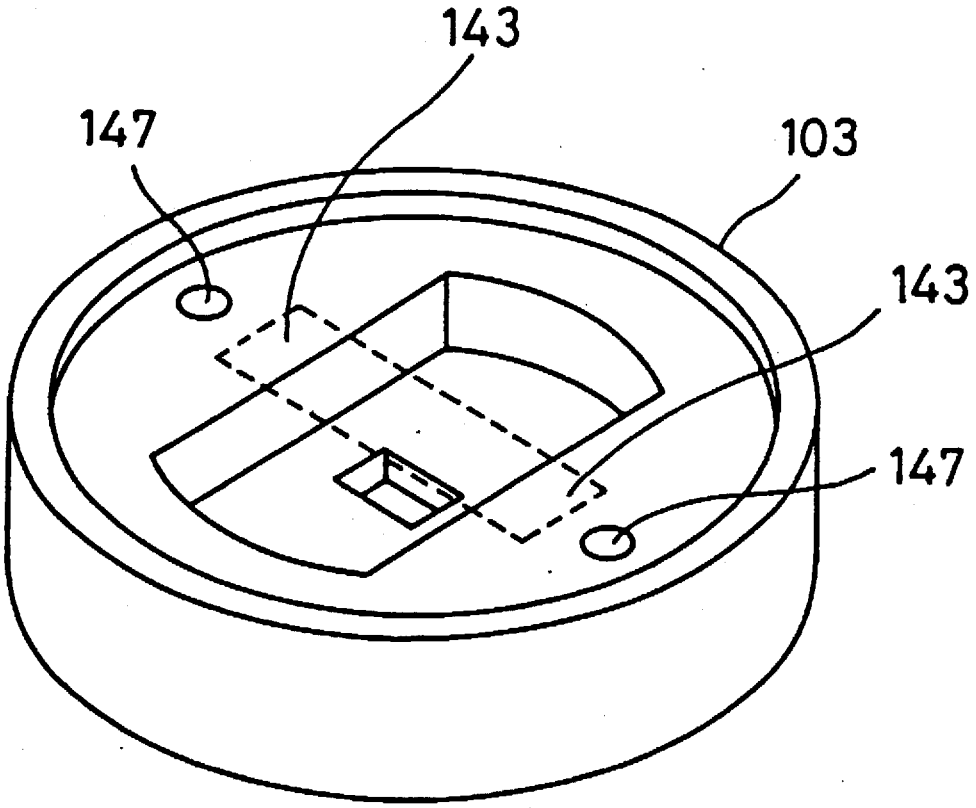
FIG. 7C is a perspective view of a die cap.

During the extrusion process, the attached covering 125 is held firmly between the assembled die mandrel and cap 105, 103. As shown in FIGS. 7A, 7B and 7C, both ends 126 of the cover 125 are held between both ends 141 of engaging portion 127 of a die mandrel 105 and the corresponding surface area 143 (shown in ghost) of a die cap 103. Moreover, to firmly engage the die cap 103 and die mandrel 105 together in accurate alignment, two projecting portions 145 are provided on the die mandrel 105, while two holes 147 for receiving the projecting portions 145 are provided in the die cap 103.

In the hollow die 101 having the aforementioned structure of the third embodiment, a separate covering 125 is formed of the same steel material as that of the die 101, and is placed over the surface of the bridges 119*a*, 119*b*. During operation, even if the covering 125 cracks, the die 101 itself can still be used simply by replacing the cracked covering 125 with a new one. Therefore, the durability of the hollow die 101 is enhanced.

In the third embodiment, only small modifications are required in the structure of the die. The precision processing the covering 125 has little influence on the die itself. Furthermore, since the bridges underlie and support the covering 125, a strong covering 125 is not demanded. Consequently, the manufacture and maintenance costs of the hollow die can be advantageously reduced.

EXPERIMENT 3

The extruding material was forced through a hollow die according to the third embodiment in order to determine whether the hollow die 101 of the third embodiment is more durable in comparison with the reference example.

In the experiment a die provided with a covering formed of the same material as that of the die and a conventional die having no covering attached thereto were tested. Extrusion was conducted under the following conditions and the dies were examined for wear and cracks. The results are shown in Table 3.

EXPERIMENTAL CONDITION

Extruding material: 7N01 (Al-4.5Zn-1.2Mg);

The steel material composing the die: SKD61;

The steel material composing the covering: SKD61;

The shape of the extruded section: square cylindrical shape;

Extrusion conditions: billet heating temperature 520° C.; and extrusion speed 10 m/min.

TABLE 3

| DIE TYPE | EXTRUDER OUTPUT | RESULTS |
|---|---|---|
| THIRD EMBODIMENT | 2000 kg | NO WEAR ON THE DIE MANDREL (COVERING WAS REPLACED FIVE TIMES) |
| REFERENCE EXAMPLE | 500 kg | A CRACK IN THE DIE |

As seen in Table 3, the die of the third embodiment with the covering attached thereto did not crack or wear, entailing only the replacement of the covering, even when the extruder output was 2000 kg, and is superior in durability. The reference example having no covering attached thereto cracked when the extruder output reached 500 kg, and has relatively poor durability.

FOURTH EMBODIMENT

The die mandrel of the fourth embodiment is similar to that of the third embodiment only the covering differs between the third and fourth embodiments. Therefore, the covering is now explained referring to FIGS. 9A–9C of the fourth embodiment.

Figure 9A:
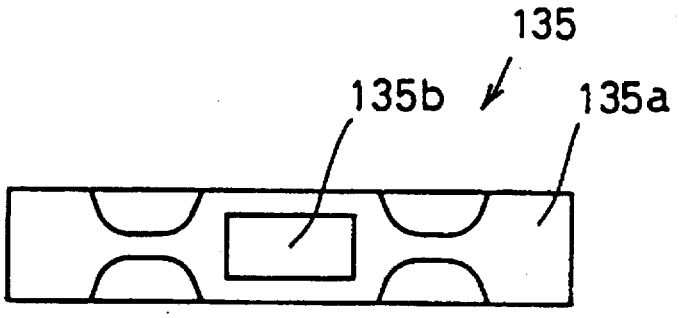
FIG. 9A is a plan view of a covering for the fourth embodiment.
Figure 9C:
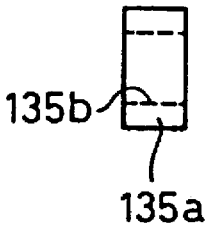
FIG. 9C is a side view of the covering.
Figure 9B:
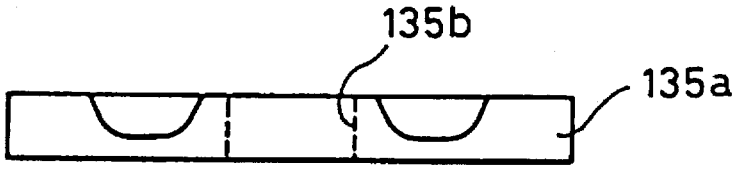
FIG. 9B is a front view of the covering.
Figure 10A:
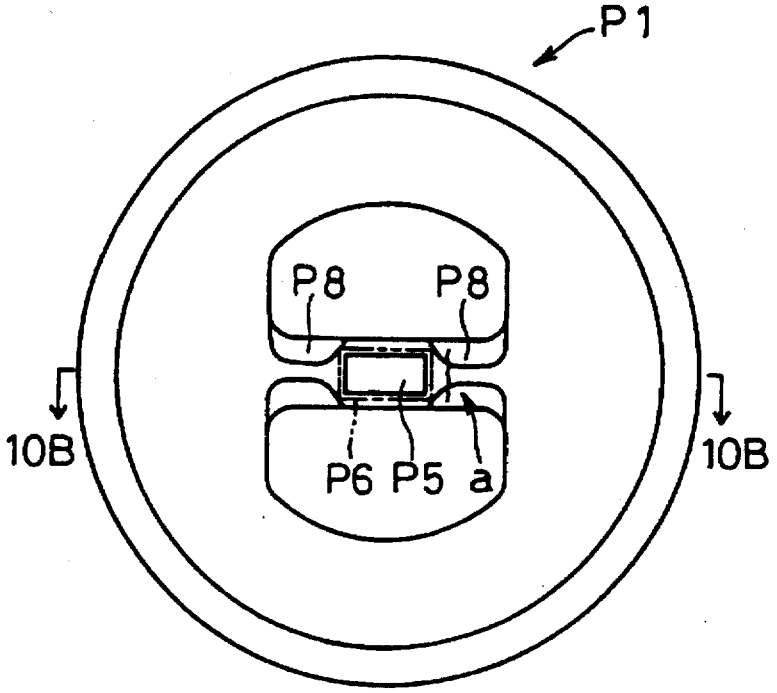
FIG. 10A PRIOR ART
FIG. 10A is a plan view of a prior art die.
Figure 10B:
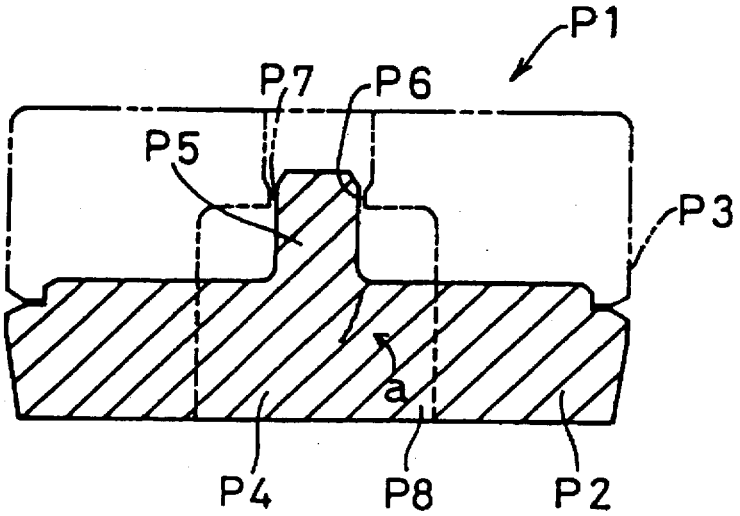
FIG. 10B PRIOR ART
FIG. 10B is a cross-sectional view of the prior art die taken along lines 10B—10B in FIG. 10A.

A covering 135 according to the fourth embodiment is composed of a nickel alloy. The composition of the alloy is 53%Ni-18.0%Cr-3.1%Co-18.5%Fe-0.18%Si. In the same manner as in the third embodiment, as shown in FIG. 9A, a hole 135*b* through which the mandrel is passed is formed in a base 135*a* of the covering 135. As shown in FIG. 9B, in the fourth embodiment the projecting portion 125C of third embodiment is not provided. The upstream facing edges of the base 135 are tapered along the bridges in the same way as are the upstream facing edges of the bridges of a conventional die.

In the fourth embodiment the separate covering 135 is attached to the die mandrel of the hollow die in the same way as the covering 128 of the third embodiment. In operation, even if the covering 135 cracks, the die itself can still be used simply by replacing the covering with a new one. Therefore, the durability of the die is enhanced. The precision in the process of the covering 135 or the strength of the covering 138 is not much demanded, thereby saving the die manufacture and maintenance costs.

In the fourth embodiment, the covering 135 has a simple configuration and can therefore be easily manufactured. The nickel alloy material of the covering 135 has a resistance to the brittleness caused by zinc, thereby extending the life of the die. Since the nickel alloy covering 135 of the fourth embodiment has a long life, it can be securely fixed onto the die mandrel.

The fourth embodiment provides a covering 135 that is different in configuration than the covering 125 of the third embodiment. However it can be appreciated that the configuration of the covering 135 of the fourth embodiment can be the same as that of the covering 125 of the third embodiment except for the covering 135 is formed of the nickel alloy.

EXPERIMENT 4

A hollow die of the fourth embodiment, which had the same configuration as that of the third embodiment, but was formed of the nickel alloy material, was used for the experiment under the following experimental conditions, so as to test the durability in the same way as in the third experiment. The results are shown in Table 4.

EXPERIMENTAL CONDITION

Extruding material: 7N01 (Al-4.5Zn-1.2Mg);

The steel material composing the die: SKD61;

The composition of the material composing the covering: 53%Ni-18.0%Cr-3.1%Co-18.5%Fe-0.18%Si;

The shape of the extruded section: square cylindrical shape;

Extrusion conditions: billet heating temperature 520° C.; and extrusion speed 10 m/min.

TABLE 4

| DIE TYPE | EXTRUDER OUTPUT | RESULTS |
|---|---|---|
| FOURTH EMBODIMENT | 2000 kg | NO WEAR ON THE DIE MANDREL AND THE COVERING |
| REFERENCE EXAMPLE | 500 kg | A CRACK IN THE DIE |

As seen in Table 4, the die of the fourth embodiment with a covering formed of the nickel alloy attached thereto had no wear or cracks on the die mandrel or on the covering, even when the extruder output was 2000 kg, and is superior in durability. The reference example having no covering attached thereto cracked when the extruder output reached 500 kg, and has relatively poor durability.

FIFTH EMBODIMENT

The covering attached to the die mandrel of a hollow die according to the fifth embodiment is similar in its configuration to the die of the third embodiment as shown in FIGS. 6A–6C. The material of the covering is a molybdenum material, different from the third and fourth embodiments.

In the same way as the third embodiment, the useful life of the hollow die of the fifth embodiment can be extended simply by replacing a cracked covering with a new one. Thus, the durability of the hollow die is enhanced. The precision required in manufacturing the covering and the strength of the covering itself are not highly demanded, thereby saving the die manufacture and maintenance costs.

In the fifth embodiment, the molybdenum material of the covering is resistant to the brittleness caused by zinc. Furthermore, when using a covering formed of the molybdenum material, the aluminum alloy extruding material does not seize, even at high temperatures. The life of the die can thus be extended even further than with the nickel alloy. Since the covering itself is durable in the fifth embodiment, it can be securely fixed to the die mandrel.

EXPERIMENT 5

A hollow die according to the fifth embodiment was used for the experiment under the following experimental conditions, so as to test the durability of the die in the same way as in the third experiment. The results are shown in Table 5.

EXPERIMENTAL CONDITION

Extruding material: 7N01 (Al-4.5Zn-1.2Mg);

The steel material composing the die: SKD61;

The material composing the covering: Super Serium Molybdenum (tradename, manufactured by Nihon Tungsten Kabushiki Kaisha);

The shape of the extruded section: square cylindrical shape;

Extrusion conditions: billet heating temperature 520° C.; and extrusion speed 10 m/min.

TABLE 5

| DIE TYPE | EXTRUDER OUTPUT | RESULTS |
|---|---|---|
| FIFTH EMBODIMENT | 3000 kg | NO WEAR ON THE DIE MANDREL AND THE COVERING |
| REFERENCE EXAMPLE | 500 kg | A CRACK IN THE DIE |

As seen in Table 5, the die of the fifth embodiment with the covering formed of the molybdenum material did not wear or crack on the die mandrel or on the covering, even when the extruder output was 3000 kg, and is superior in durability. The reference example having no covering attached thereto cracked when the extruder output reached 500 kg, and has relatively poor durability.

This invention has been described above with reference to the preferred embodiments as shown in the figures and tables. Modifications and alterations may become apparent to one skilled in the art upon reading and understanding the specification. Despite the use of the embodiments for illustration purposes, the invention is intended to include all such modifications and alterations within the spirit and scope of the invention.

In the spirit of the invention, when the covering of the third through fifth embodiments is formed of a durable material, it can be fixed to the die mandrel. Moreover, the configuration of the covering is not limited to that of the third and fourth embodiments.

As aforementioned, in the hollow die for extruding a hollow section of a zinc-containing aluminum alloy according to the invention, the root of the mandrel of the die mandrel or the upstream facing surfaces of the bridges are coated with a layer that is resistant to the brittleness caused by zinc. Therefore, the die can be protected from cracks and given a long life by applying such a zinc resistant coating without substantially changing the structure of the die.

Also according to further embodiments of the invention, the upstream surface of the mandrel support of the die mandrel or the upstream surface of the bridges is provided with a removable covering. Therefore, if the covering cracks during operation, the die itself can still be used just by replacing the covering with a new on, giving the die an extended life. When the removable covering is attached to the die mandrel, it can be easily removed and replaced with a new one.

The attachment of the covering does not require any substantial change in the structure of the die and does not adversely affect the die in terms of the precision required in manufacturing the die. Moreover, since the covering is supported by the bridges, a strong covering is not demanded. Consequently, the manufacture and maintenance cost of the die are reduced.

When the material of the covering has a resistance to the brittleness caused by zinc, the covering itself has an extended life and can be permanently fixed to the die mandrel.

The use of the hollow die of the invention raises the productivity and reduces the preparation cost of extruding materials.

Figure 8:
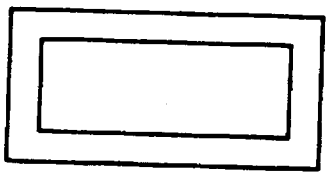
FIG. 8 is an explanatory view showing the shape of an extruded section.

In the aforementioned embodiments, the circular cylindrical section shown in FIG. 3A and the square cylindrical section shown in FIGS. 3B, 8 are extruded. The configuration of the extruded section is not limited to these. The section having the configuration shown in FIG. 3C can also be extruded.

Wherefore, what is claimed is:

1. A method of protecting an extruding die from cracks due to brittleness caused by zinc when extruding a hollow aluminum alloy section containing zinc, said extruding die having a die mandrel part in combination with a die cap part, said die mandrel part having a main body portion having a through hole passing therethrough with a mandrel, for forming the hollow extruding section, being supported in the through hole by at least one bridge portion that at least partially defines a root portion of said mandrel, and said die cap part having an extruding hole passing therethrough for forming a peripheral portion of the extruding section, said method comprising the steps of:

making a coating fast with and completely covering said at least one bridge portion and said root portion of the die mandrel part, said coating being resistant to said brittleness caused by zinc and preventing said zinc from contacting said root portion, thereby to resist cracking of said root portion;

making a coating fast with and completely covering an inner surface of said die cap part;

positioning the die cap part so that it covers the bridge portion and the root portion of the die mandrel part; and extruding an aluminum alloy containing zinc through the mandrel part and the die cap part whereby stress is placed directly on the die cap part and indirectly on the bridge portion and the root portion of the die mandrel part thereby extending the life of the die.

2. A method according to claim 1, further comprising the step of using a coating selected from the group consisting of a nickel alloy 53% by weight Ni, 18.0% by weight Cr, 3.1% by weight Co, 18.5% by weight Fe and 0.18% by weight Si and a nickel alloy 53% by weight Ni, 17.5% by weight Cr, 18.5% by weight Co and 4% by weight Mo.

3. A method according to claim 1, comprising the steps of:

welding said coating to said root portion and said bridge portion; and polishing a surface of said coating.

4. A method according to claim 1, comprising the steps of:

welding a plurality of layers of said coating to said root portion and said bridge portion; and polishing a surface of said coating.

5. An extruding die for extruding a hollow aluminum alloy section containing zinc, said extruding die comprising:

a die mandrel part in combination with a die cap part, said die mandrel part having a mandrel and said die cap part having an extruding hole passing therethrough, and said mandrel and said extruding hole cooperating with one another for forming a hollow extruding section, said mandrel having a root portion and a bridge portion; and a coating formed of a nickel alloy, which is resistant to brittleness caused by the zinc contained in the aluminum alloy, being fast with said root portion and said bridge portion and exposed to said zinc to prevent said zinc from contacting said root portion and said bridge portion, thereby to resist cracking of said root portion and said bridge portion.

6. An extruding die for extruding a hollow aluminum alloy section containing zinc, said extruding die comprising:

a die mandrel part in combination with a die cap part, said die mandrel part having a mandrel, a main body portion having a through hole passing therethrough with said mandrel being supported in the through hole by at least one bridge wherein said at least one bridge at least partially defines a root portion and said die cap part having an extruding hole passing therethrough;

wherein said mandrel and said extruding hole cooperate with one another to form a hollow extruding section; and said at least one bridge and said root portion of said mandrel are completely covered with a coating which is resistant to brittleness caused by the zinc contained in the aluminum alloy, the coating is fast with said root portion and said bridge and is exposed to said zinc to prevent said zinc from contacting said root portion and said bridge, thereby to resist cracking of said root portion and said bridge resulting in extended life of the die.

7. A die according to claim 6, wherein said coating is selected from the group consisting of a nickel alloy 53% by weight Ni, 18.0% by weight Cr, 3.1% by weight Co, 18.5% by weight Fe and 0.18% by weight Si and a nickel alloy 53% by weight Ni, 17.5% by weight Cr, 18.5% by weight Co and 4% by weight Mo.

8. The die according to claim 6, wherein tensile stresses act upon said at least one bridge and said root portion during extrusion so that the coating protects against embrittlement.

9. The die according to claim 6, wherein said coating is formed of a super cerium molybdenum.

10. The die according to claim 9, wherein said coating comprises a cerium element and a molybdenum element and said coating has increased re-crystallizing temperature, increased mechanical strength and increased toughness as compared with an alloy of molybdenum added with Si, K, Al, or Zr.

11. The die according to claim 6, wherein said die cap part comprises an inner surface which covers the mandrel, the root of the mandrel and the bridge of the mandrel when the two are interconnected where the inner surface is completely covered with the coating and the die cap part is positioned to completely cover the bridge and the root portion so that stress is placed directly on the die cap part and indirectly on the die during extrusion thereby extending the life of the die.

12. The die according to claim 6, wherein said die cap part has stress placed directly on it during extrusion resulting in decreased wear of the die cap part and wherein said die cap part is replaceable once wear begins.

* * * * *